United States Patent [19]

Davis

[11] 4,182,955

[45] Jan. 8, 1980

[54] X-RAY GENERATING TUBES

[75] Inventor: Gordon P. Davis, Sunbury-on-Thames, England

[73] Assignee: E M I Limited, Hayes, England

[21] Appl. No.: 911,405

[22] Filed: Jun. 1, 1978

[30] Foreign Application Priority Data

Oct. 26, 1977 [GB] United Kingdom ..... 44648/77

[51] Int. Cl.[2] ..... H05G 1/30

[52] U.S. Cl. ..... 250/402; 250/403; 313/55

[58] Field of Search ..... 250/402, 406, 405, 403, 250/404; 313/515

[56] References Cited

U.S. PATENT DOCUMENTS 3,942,015 3/1976 Huxley ..... 250/406

*Primary Examiner*—Craig E. Church

*Attorney, Agent, or Firm*—Cooper, Dunham, Clark, Griffin & Moran

[57] ABSTRACT

An X-ray tube in which the electron beam is deflected over the X-ray emissive anti-cathode is provided with an anti-cathode, the surface on which the electrons impinge is corrugated in order to aid in the dissipation of heat.

2 Claims, 2 Drawing Figures

X-RAY GENERATING TUBES

The present invention relates to x-ray generating tubes, and it relates especially, though not exclusively, to such tubes as may be used as sources x-radiation in computerised axial tomographic (CAT) apparatus.

Examples of CAT apparatus are described and claimed in U.S. Pat. No. 3,778,614 from which it will be observed that data, indicative of the absorption suffered by penetrating radiation on traversing each of many substantially co-planar, pencil-like beam paths across a cross-sectional slice of a body under examination, are processed by a technique now known as filtered back-projection to evaluate the absorption coefficient, with respect to the radiation used, of the body material at each of a large number of locations distributed over the slice.

As the art of computerised tomography has progressed, much effort has been expended in attempting to speed up the acquistion of the absorption data, such acquisition being effected by scanning a source of radiation, and possibly also a detector means, relative to the patient's body. As the acquisition rate has been increased, so have the demands, in terms of emission of radiation, and in terms of physical complexity, upon the sources of radiation used.

An x-ray tube, suitable for use in CAT apparatus exhibiting a high rate of data acquisition, has been proposed in which the electron beam thereof can be scanned in steps across an elongated, x-ray emissive anti-cathode. The fact that the x-rays are emitted sequentially from regions distributed over an extended area of the anti-cathode mitigates the cooling problems associated with high x-ray emission levels, but additional cooling can still be advantageous. It is an object of this invention to provide an x-ray tube of the kind in which the electron beam thereof can be scanned in steps over an alongated anit-cathode and which incorporates means for effecting such additional cooling.

According to the invention there is provided an x-ray tube having an elongated, X-ray emissive anti-cathode, a source of an electron beam and means for deflecting the beam in steps across said anti-cathode, wherein the surface of said anti-cathode upon which said beam impinges is corrugated.

One example of the invention will now be described with reference to the accompanying drawings, of which;

Figure 1:
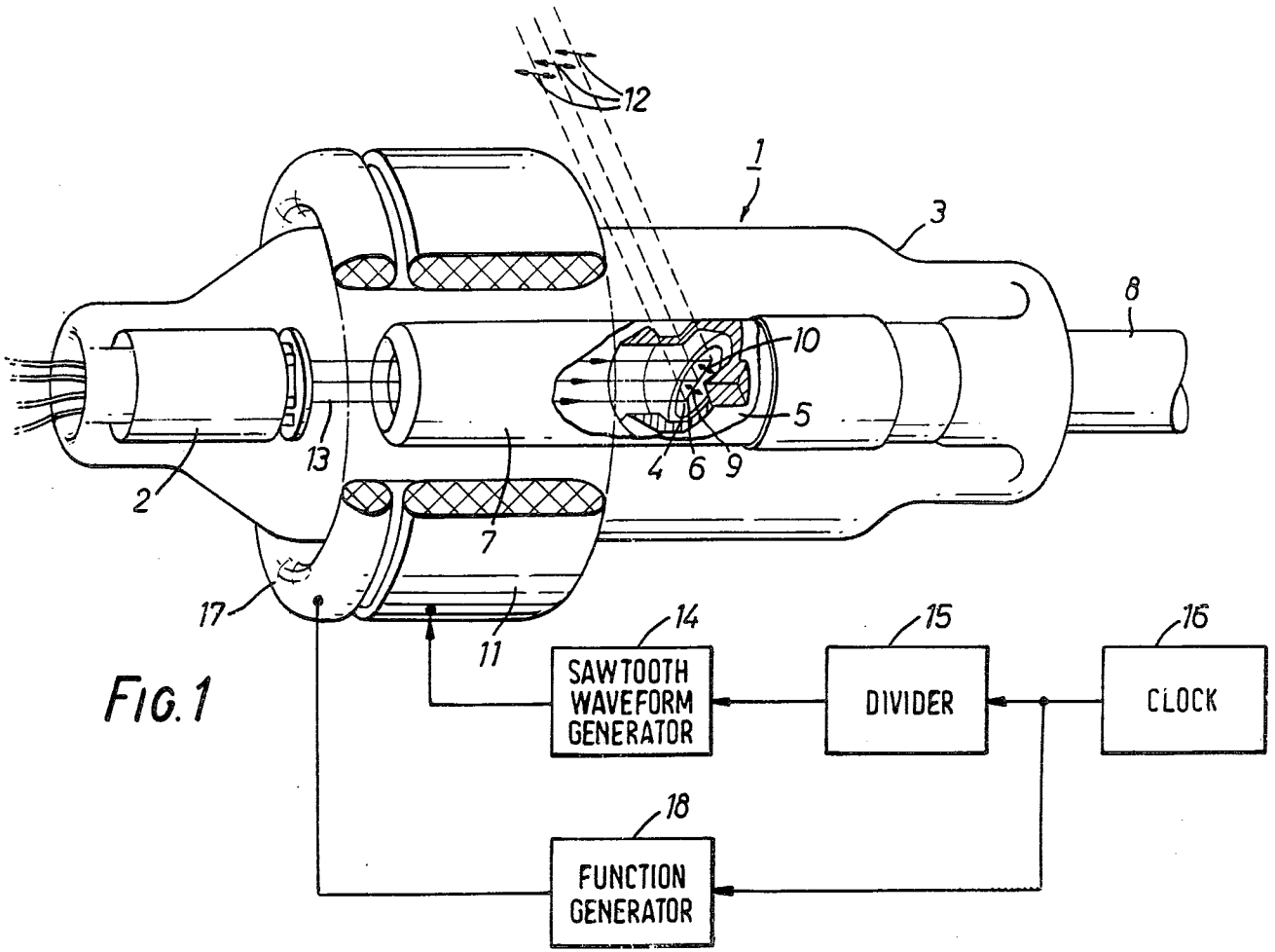
FIG. 1 shows a tube in accordance with one example of this invention.

Referring now to FIG. 1, an X-ray generating tube 1 includes an electron gun 2 which is arranged to project electrons in a ribbon-like beam 13 axially of the tube. The tube 1 is formed with a glass envelope 3 and contains an anti-cathode comprising a tungsten target 4 set in a copper anode 5. The tube 1 is formed with a glass envelope 3 and contains an anti-cathode comprising a tungsten target 4 set in a copper anode 5. The tungsten target 4 emits X-rays, in response to the impingement thereon of the electrons from the gun 2, and has a characteristic form, in accordance with this invention, which will be described in more detail hereinafter with reference to FIG. 2. Returning for the moment to the description of the tube shown in FIG. 1, the electrons are intended to impinge upon a line 6 about 1 mm wide on the target 4, and a drift tube 7, axially disposed in the tube 1 and projecting from the anode 5 towards the gun 2, is provided (in known manner) to produce the potentials which have to be applied to the tube components in order to establish a given strength of electric field in the tube. A cooling system of known kind, generally indicated at 8, is provided to cool the target anode member 4, 5. Forced oil cooling is a convenient technique.

In order that the electron beam 13 can be deflected across the target 4 in a direction substantially perpendicular to its length, as indicated by the arrows 9, 10, suitable scanning coils 11 are disposed around the tube 1 as shown. The deflection of the electron beam causes deflection of the X-radiation emitted from the target 4 as shown by the arrows 12. Typically, the electromagnetic deflection coils 11 are fed with electrical waveforms of sawtooth shape, derived in known manner from a sawtooth waveform generator circuit 14. The waveforms generated by the circuit 14 are triggered by timing pulses applied thereto from a clock pulse generating circuit 16 and by way of a divider circuit 15, which divides by n in frequency the pulses applied thereto from circuit 16. The divider circuit 15 can conveniently comprise an n stage binary counter which provides an output pulse and a reset pulse every time it has counted n of the clock pulses.

As thus far described, the electron beam 13 is swept linearly across the target 4 and flies back again at a frequency 1/n th of the frequency at which the clock pulses are generated.

In order to convert the linear sweep into a stepped sweep, during which the electron beam dwells at certain regions of the member 2 and moves rapidly between such regions, it is convenient, though not necessary, to provide another coil 17 around the envelope 3. Conveniently, the coil 17 is supplied with electrical waveforms applied thereto from a function generating circuit 18 which, in turn, receives and is synchronised by the clock pulses supplied by the clock pulse generating circuit 16. A suitable function to be generated by the circuit 18 is described in more detail in U.S. patent application Ser.No. 911,404, filed June 1st, 1978 which claims priority from British patent application No. 23612/77, the disclosure of which is hereby incorporated by reference, but suffice to say that the effects of the deflection coils 11 and 17, and the waveforms applied thereto, upon the beam 13 cause the beam to effect the desired stepped sweep motion. In the example referred to, because of the dividing factor n introduced by divider circuit 15, the beam will dwell in succession at n equally spaced regions along the target 4.

Figure 2:
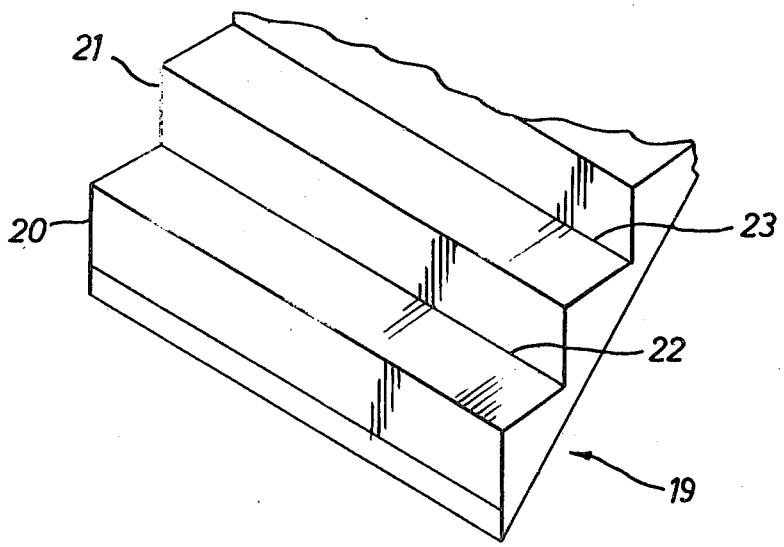
FIG. 2 show on an enlarged scale, a portion of the anti-cathode incorporated in the x-ray tube shown in FIG. 1.

Referring now to FIG. 2, part of the target 5 of the x-ray emissive anti-cathode is shown at 19. The anti-cathode is formed with ridges, such as 20 and 21, to increase its surface area and thereby improve the heat dissipation capability thereof. The lands, such as 23 and 24, between the ridges, can be V-shaped, as shown in FIG. 2, or flattened. The electron beam of the tube is scanned in steps across the anti-cathode so that it dwells only on the lands and is swept rapidly across the ridges. If this is not done, the ridges can become damaged and the performance of the tube degraded.

Advantageously, the ridges can be of sufficient amplitude and suitably shaped to act as collimators, forming the emitted radiation into a fan-like shape.

Other forms of modulation of the target surface of the anti-cathode, upon which the electron beam of the tube impinges, such as parabolic lands and cusped ridges, can be used without departing from the scope of the invention.

What I claim is:

1. An X-ray tube having an elongated, X-ray emissive anti-cathode, a source of an electron beam and means for deflecting the beam in steps across said anti-cathode, causing the beam to dwell at, and X-rays to be emitted from, a sequence of spaced locations distributed across said anti-cathode, wherein the surface of said anti-cathode upon which said beam impinges is corrugated in alternate ridges and lands running transversely to the direction in which the deflection of the beam occurs and with the said locations disposed in said lands; the beam alternately sweeping rapidly across the ridges and dwelling in the lands.

2. A tube according to claim 1 wherein said corrugations are substantially V-shaped.

* * * * *